US011371338B2

(12) United States Patent
Alexeyenko

(10) Patent No.: US 11,371,338 B2
(45) Date of Patent: Jun. 28, 2022

(54) APPLIED COOLING FOR ELECTRONICS OF DOWNHOLE TOOL

(71) Applicant: Saudi Arabian Oil Company, Dhahran (SA)

(72) Inventor: Alexey Alexeyenko, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 212 days.

(21) Appl. No.: 16/889,538

(22) Filed: Jun. 1, 2020

(65) Prior Publication Data

US 2021/0372268 A1 Dec. 2, 2021

(51) Int. Cl.
*E21B 47/017* (2012.01)
*F25B 13/00* (2006.01)
*E21B 47/18* (2012.01)

(52) U.S. Cl.
CPC ..... *E21B 47/0175* (2020.05); *F25B 13/00* (2013.01); *E21B 47/18* (2013.01)

(58) Field of Classification Search
CPC .. E21B 47/017; E21B 47/0175; E21B 36/001; F25B 13/00; F25B 21/02
See application file for complete search history.

(56) References Cited

U.S. PATENT DOCUMENTS 5,265,677 A * 11/1993 Schultz ..... E21B 47/017 166/57
5,701,751 A * 12/1997 Flores ..... H05K 7/20354 62/169
6,769,487 B2 * 8/2004 Hache ..... E21B 36/001 166/57
7,246,940 B2 7/2007 Storm et al.
7,308,795 B2 * 12/2007 Hall ..... E21B 41/0085 62/3.2

(Continued)

FOREIGN PATENT DOCUMENTS

CN 1641185 A * 7/2005 ..... E21B 47/011
CN 109630097 A 4/2019

(Continued)

OTHER PUBLICATIONS

Monteiro et al., "Temperature Control of Drilling Fluid with Phase-Change Materials", 2012, https://www.researchgate.net/publication/267345478_Temperature_Control_of_Drilling_Fluid_with_Phase-Change_Materials.

(Continued)

*Primary Examiner* — Jennifer H Gay
(74) *Attorney, Agent, or Firm* — Bracewell LLP; Constance G. Rhebergen; Linda L. Morgan

(57) ABSTRACT

Systems and methods for cooling an electronics compartment of a downhole tool include a tool assembly. The tool assembly is an elongated member formed of axially aligned tool units. The tool units include a turbine and the electronics compartment. The electronics compartment has an interior cavity containing electronics components. The tool units further include a compressor powered by the turbine. The compressor is operable to compress a coolant fluid. The compressor has a central heat exchanger operable to cool a non-electrically conductive fluid with the coolant fluid. An impeller is rotated by the turbine. The impeller is operable to circulate the non-electrically conductive fluid past the electronics components.

18 Claims, 2 Drawing Sheets

(56) References Cited

U.S. PATENT DOCUMENTS

| | | | | |
|---|---|---|---|---|
| 7,527,101 | B2 * | 5/2009 | Mayes | E21B 47/017 166/302 |
| 8,024,936 | B2 | 9/2011 | Storm et al. | |
| 8,453,760 | B2 | 6/2013 | Fincher et al. | |
| 8,567,500 | B2 | 10/2013 | Bedouet et al. | |
| 8,826,984 | B2 | 9/2014 | Sanderlin et al. | |
| 9,353,618 | B2 * | 5/2016 | Jung | E21B 47/017 |
| 9,932,817 | B1 * | 4/2018 | Kusmer | F25B 39/04 |
| 10,012,054 | B2 | 7/2018 | Ciglenec et al. | |
| 10,358,908 | B2 * | 7/2019 | Kusmer | F04B 1/00 |
| 2004/0112601 | A1 * | 6/2004 | Hache | E21B 47/017 166/57 |
| 2006/0102353 | A1 * | 5/2006 | Storm | E21B 47/017 166/57 |
| 2006/0162931 | A1 * | 7/2006 | Mayes | E21B 47/017 166/57 |
| 2006/0191682 | A1 * | 8/2006 | Storm | E21B 47/017 166/250.01 |
| 2006/0266064 | A1 * | 11/2006 | Rowatt | F25B 9/14 62/6 |
| 2011/0079391 | A1 * | 4/2011 | Bedouet | E21B 47/017 166/57 |
| 2017/0292533 | A1 * | 10/2017 | Zia | E21B 43/121 |
| 2018/0230793 | A1 * | 8/2018 | Kusmer | F25B 1/005 |
| 2018/0347336 | A1 * | 12/2018 | Kusmer | F25B 25/00 |
| 2021/0372268 | A1 * | 12/2021 | Alexeyenko | F25B 13/00 |

FOREIGN PATENT DOCUMENTS

| | | | | |
|---|---|---|---|---|
| CN | 109653708 | A * | 4/2019 | E21B 36/001 |
| EP | 2246523 | A1 | 11/2010 | |
| NO | 20130156 | A1 * | 8/2013 | E21B 47/017 |

OTHER PUBLICATIONS

International Search Report and Written Opinion for PCT Application No. PCT/US2021/035124 dated Sep. 14, 2021.

* cited by examiner

APPLIED COOLING FOR ELECTRONICS OF DOWNHOLE TOOL

BACKGROUND OF THE DISCLOSURE

1. Field of the Disclosure

The present disclosure relates to subterranean well development, and more specifically, the disclosure relates to the cooling of downhole tools during well development operations.

2. Description of the Related Art

Tools and equipment used within a wellbore during the development of subterranean wells can include electronics that can be temperature sensitive. Electronics employed in downhole drilling tools have working parameters limited by downhole temperature which can exceed 300 degrees Fahrenheit (° F.). Some currently available downhole electronics are designed to work at temperatures below 320° F. If the electronics reach temperatures that exceed the design maximum working temperature of the electronics, the electronics can fail and can result in non-productive time periods during drilling operations.

SUMMARY OF THE DISCLOSURE

Embodiments of the current application provide systems and method for cooling electronics components of a downhole tool. A compressor assembly is included in the downhole tool. The compressor assembly compresses a coolant fluid. A central heat exchanger of the compressor assembly reduces the temperature of a non-electrically conductive fluid with the coolant. The non-electrically conductive fluid fills the internal volume of the electronics compartment that houses the electronics components. The compressor is powered by a turbine that is part of the downhole tool. The compressor can also drive an impeller that circulates the non-electrically conductive fluid inside of the electronics compartment.

In an embodiment of this disclosure, a system for cooling an electronics compartment of a downhole tool includes a tool assembly. The tool assembly is an elongated member formed of axially aligned tool units. The tool units include a turbine and the electronics compartment. The electronics compartment has an interior cavity containing electronics components. The tool units further include a compressor powered by the turbine. The compressor is operable to compress a coolant fluid. The compressor has a central heat exchanger operable to cool a non-electrically conductive fluid with the coolant fluid. An impeller is rotated by the turbine. The impeller is operable to circulate the non-electrically conductive fluid past the electronics components.

In alternate embodiments, a centralizer can circumscribe the tool assembly and be operable to centralize the tool assembly within an outer tool tubular. The outer tool tubular can be secured in-line with a drilling string. The tool assembly can define a measurement while drilling downhole tool. The tool assembly can have an axial length in a range of 5 meters to 10 meters. The electronics components can be submerged within the non-electrically conductive fluid.

In an alternate embodiment of this disclosure, a system for cooling an electronics compartment of a downhole tool includes a tool assembly. The tool assembly is an elongated member formed of axially aligned tool units. The tool units include a turbine located at a downhole end of the tool assembly. The tool units further include a rotary compressor located axially adjacent to the turbine and rotated by the turbine. The rotary compressor is operable to compress a coolant fluid. The rotary compressor has a central heat exchanger operable to cool a non-electrically conductive fluid with the coolant fluid. The tool units further include the electronics compartment that is located axially adjacent to the rotary compressor. The electronics compartment has an interior cavity containing electronics components. An impeller is rotated by the turbine. The impeller is operable to direct the non-electrically conductive fluid from the rotary compressor to the electronics compartment.

In alternate embodiments, a centralizer can circumscribe the tool assembly and be operable to centralize the tool assembly within an outer tool tubular. The outer tool tubular can be secured in-line with a drilling string. An outer heat exchanger of the compressor can be in thermal communication with a flow of fluid external to the tool assembly that is within the outer tool tubular. The tool assembly can have an axial length in a range of 5 meters to 10 meters. The electronics components can be submerged within the non-electrically conductive fluid.

In another embodiment of this disclosure, a method for cooling an electronics compartment of a downhole tool includes forming a tool assembly. The tool assembly is an elongated member formed of axially aligned tool units. The tool units include a turbine and the electronics compartment. The electronics compartment has an interior cavity containing electronics components. The tool units further include a compressor with a central heat exchanger. The tool units also has an impeller. The method further includes powering the compressor with the turbine to compress a coolant fluid and cooling a non-electrically conductive fluid with the coolant fluid in the central heat exchanger. The impeller is rotated with the turbine to circulate the non-electrically conductive fluid past the electronics components.

In alternate embodiments, the tool assembly can be centralized within an outer tool tubular with a centralizer circumscribing the tool assembly. The outer tool tubular can be secured in-line with a drilling string. Forming the tool assembly can include forming the tool assembly that is a measurement while drilling downhole tool. Forming the tool assembly can alternately include forming the tool assembly with an axial length in a range of 5 meters to 10 meters. The method can include submerging the electronics components within the non-electrically conductive fluid.

BRIEF DESCRIPTION OF THE DRAWINGS

So that the manner in which the features, aspects and advantages of the embodiments of this disclosure, as well as others that will become apparent, are attained and can be understood in detail, a more particular description of the disclosure may be had by reference to the embodiments thereof that are illustrated in the drawings that form a part of this specification. It is to be noted, however, that the appended drawings illustrate only certain embodiments of the disclosure and are, therefore, not to be considered limiting of the disclosure's scope, for the disclosure may admit to other equally effective embodiments.

DETAILED DESCRIPTION

The disclosure refers to particular features, including process or method steps. Those of skill in the art understand that the disclosure is not limited to or by the description of embodiments given in the specification. The subject matter of this disclosure is not restricted except only in the spirit of the specification and appended Claims.

Those of skill in the art also understand that the terminology used for describing particular embodiments does not limit the scope or breadth of the embodiments of the disclosure. In interpreting the specification and appended Claims, all terms should be interpreted in the broadest possible manner consistent with the context of each term. All technical and scientific terms used in the specification and appended Claims have the same meaning as commonly understood by one of ordinary skill in the art to which this disclosure belongs unless defined otherwise.

As used in the Specification and appended Claims, the singular forms "a", "an", and "the" include plural references unless the context clearly indicates otherwise.

As used, the words "comprise," "has," "includes", and all other grammatical variations are each intended to have an open, non-limiting meaning that does not exclude additional elements, components or steps. Embodiments of the present disclosure may suitably "comprise", "consist" or "consist essentially of" the limiting features disclosed, and may be practiced in the absence of a limiting feature not disclosed. For example, it can be recognized by those skilled in the art that certain steps can be combined into a single step.

Where a range of values is provided in the Specification or in the appended Claims, it is understood that the interval encompasses each intervening value between the upper limit and the lower limit as well as the upper limit and the lower limit. The disclosure encompasses and bounds smaller ranges of the interval subject to any specific exclusion provided.

As used in this Specification, the term "substantially equal" means that the values being referenced have a difference of no more than two percent of the larger of the values being referenced.

Where reference is made in the specification and appended Claims to a method comprising two or more defined steps, the defined steps can be carried out in any order or simultaneously except where the context excludes that possibility.

Figure 1:
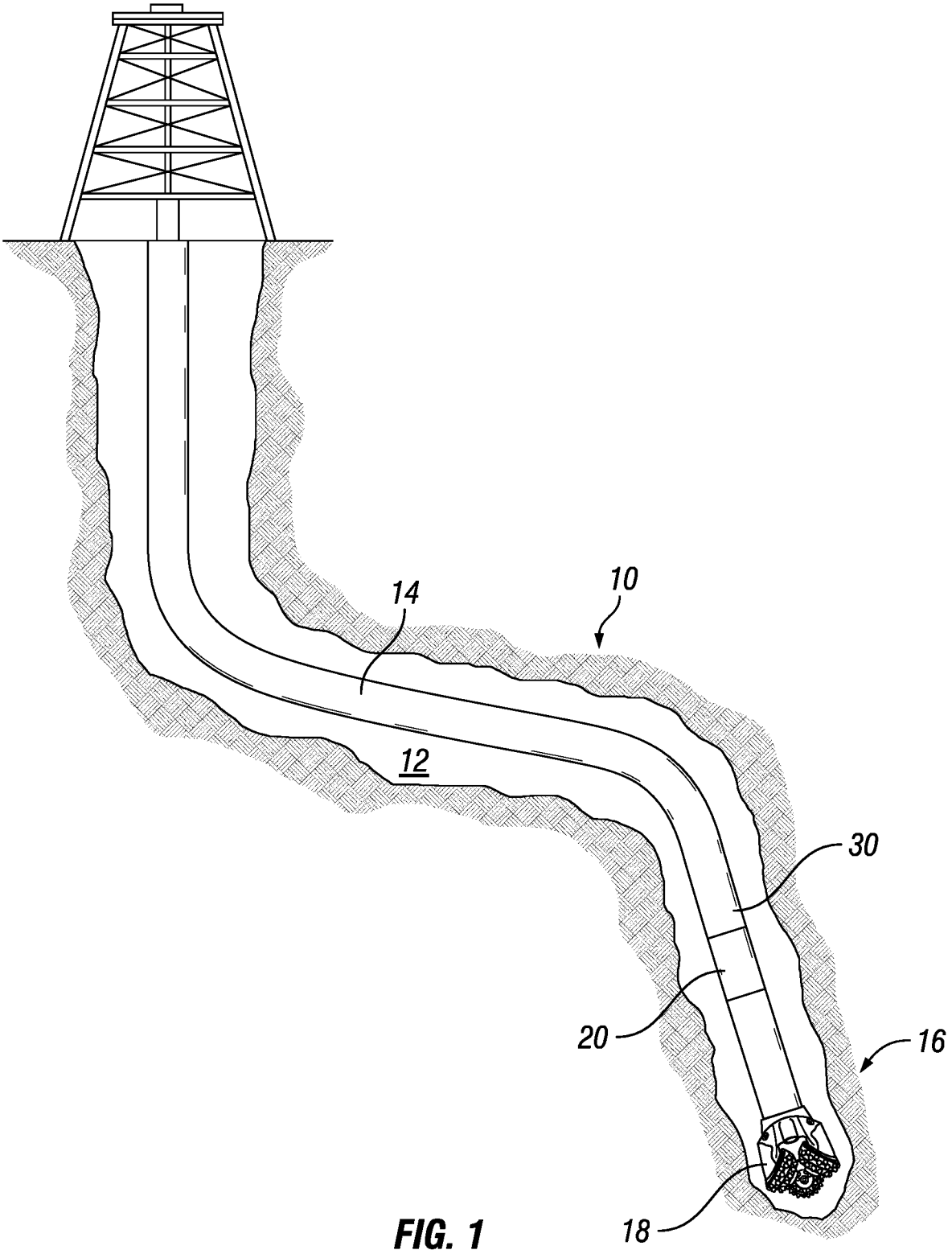
FIG. 1 is a partial section view of a subterranean well with a system for cooling an electronics compartment of a downhole tool, in accordance with an embodiment of this disclosure.

Looking at FIG. 1, subterranean well 10 extends downwards from a surface of the earth, which can be a ground level surface or a subsea surface. Bore 12 of subterranean well 10 can extended generally vertically relative to the surface. Bore 12 can alternately include portions that extend generally horizontally or in other directions that deviate from generally vertically from the surface. Subterranean well 10 can be a well associated with hydrocarbon development operations, such as a hydrocarbon production well, an injection well, or a water well.

Tubular string 14 extends into bore 12 of subterranean well 10. Tubular string 14 can be, for example, a drill string, a casing string, or another elongated member lowered into subterranean well 10. Although bore 12 is shown as an uncased opening, in embodiments where tubular string 14 is an inner tubular member, bore 12 can be part of an outer tubular member, such as casing.

Tubular string 14 can include downhole tools and equipment that are secured in line with joints of tubular string 14. Tubular string 14 can have, for example, a bottom hole assembly 16 that can include a drill bit 18. Drill bit 18 can rotate to create bore 12 of subterranean well 10.

Tubular string 14 can further include downhole tool 20. In the example embodiment of FIG. 1, tubular string 14 is a drill string that can include downhole tool 20 that is a measurement while drilling downhole tool. In alternate embodiments, downhole tool 20 can be another downhole tool that includes electronics components within an electronics compartment that are at risk of overheating.

Measurement while drilling tools can utilize instruments such as sensors, gauges, gyroscopes, accelerometers, and magnetometers to provide real time data relating to the drilling operation. The data collected by the downhole measurement while drilling tools can be transmitted to the surface, such as through mud pulse telemetry. The data received at the surface can be interpreted and evaluated to assist the operators in understanding downhole properties and conditions.

Figure 2:
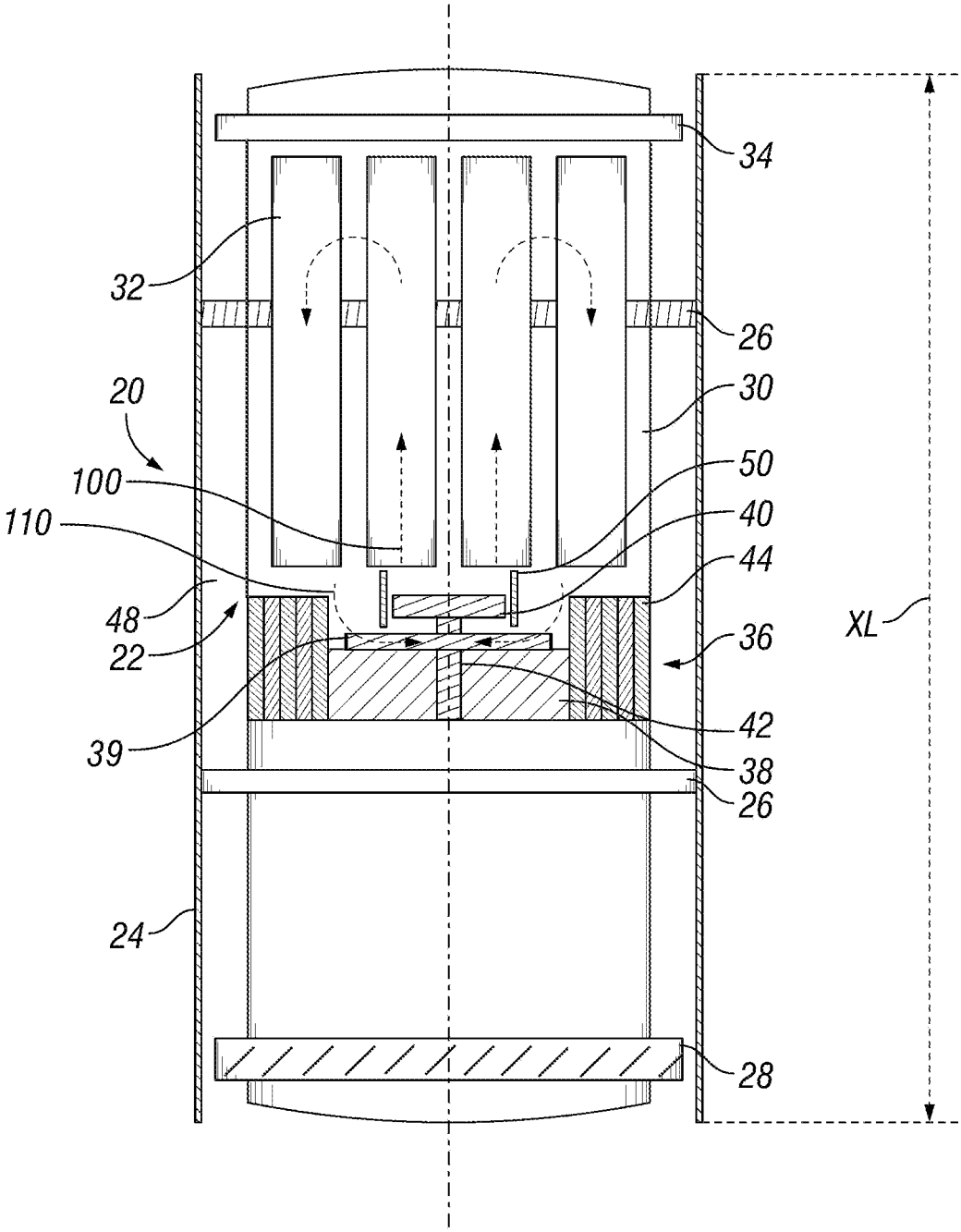
FIG. 2 is a schematic partial section view of a system for cooling an electronics compartment of a downhole tool, in accordance with an embodiment of this disclosure.

Looking at FIG. 2, in an example embodiment downhole tool 20 is a measurement while drilling downhole tool. Downhole tool 20 includes tool assembly 22. Tool assembly 22 is formed of a series of axially aligned tool units. Downhole tool 20 can have an axial length XL that is in a range of 5 meters to 10 meters. In an example embodiment, downhole tool 20 can have an axial length XL of 8 meters.

Tool assembly 22 is an elongated member that is centralized within outer tool tubular 24 by centralizers 26. Centralizers 26 circumscribe tool assembly 22 and centralize tool assembly 22 within outer tool tubular 24.

Outer tool tubular 24 is an elongated tubular member with an internal bore that houses tool assembly 22. Outer tool tubular 24 can be secured in-line with tubular string 14. Outer tool tubular 24 can be secured in-line with tubular string 14 by common connection systems, such as by threaded connections, flange connections, or other known drill string connector systems. Outer tool tubular 24 can have an outer diameter that is consistent with the outer diameter of joints of tubular string 14.

The tool units of tool assembly 22 can include turbine 28. Turbine 28 can be located at a downhole end of tool assembly 22. Turbine 28 can provide the power for the operation of tool assembly 22. A flow of fluid, such as a flow of drilling fluid, over a rotor of turbine 28 can transmit a rotational force to an alternator that can generate an electrical current.

The tool units of tool assembly 22 can further include electronics compartment 30. Electronics compartment 30 has an interior cavity containing electronics components 32. Electronics components 32 can include, for example, a circuit printed board assembly, a memory, a processor, and sensors The tool units of tool assembly 22 can also include mud pulse modulator 34 located at an uphole end of tool assembly 22. Mud pulse modulator 34 can be used to transmit data gathered by tool assembly 22 to the surface. As an example, mud pulse modulator 34 can convert data gathered by tool assembly 22 to an amplitude- or frequency-modulated pattern of mud pulses, which mud pulses are received at the surface for interpretation.

The tool units of tool assembly 22 can still further include cooling system 36 to lower the temperature of electronics components 32. Cooling system 36 includes compressor 38. In the example embodiment of FIG. 2, compressor 38 is a rotary compressor powered by turbine 28. Compressor 38 can be located axially adjacent to turbine 28.

Compressor 38 can compress a coolant fluid. The coolant fluid will cool down central heat exchanger 39. Central heat exchanger 39 will in turn cool down a non-electrically conductive fluid that fills electronics compartment 30. As an example, the non-electrically conductive fluid can be 1,1,1,2,2,4,5,5,5-Nonafluoro-4-(trifluoromethyl)-3-pentanone (3M™ Novec™) or similar fluid. Due to the non-electrically conductive properties of the non-electrically conductive fluid, electronics components 32 can be submerged within the non-electrically conductive fluid. This allows for direct cooling of electronics components 32 by the non-electrically conductive fluid.

The non-electrically conductive fluid can be circulated past electronics components 32 by impeller 40. Impeller 40 is mechanically connected to power shaft 42. Power shaft 42 is rotated by turbine 28. Therefore, impeller 40 is rotated by turbine 28 by way of power shaft 42. Impeller 40 is shaped and positioned so that as impeller 40 rotates, impeller 40 directs the cooled non-electrically conductive fluid from central heat exchanger 39 of the compressor 38 to electronics compartment 30.

As the non-electrically conductive fluid is circulated past electronics components 32, the non-electrically conductive fluid will be warmed as the non-electrically conductive fluid absorbs heat from electronics components 32. The warmed non-electrically conductive fluid will circulate back to central heat exchanger 39 of compressor 38 to be cooled.

A radially outward portion of compressor 38 can include outer heat exchanger 44. Outer heat exchanger 44 is in thermal communication with a flow of fluid external to tool assembly 22 that is within outer tool tubular 24. Outer heat exchanger 44 can allow the coolant fluid to lose heat to the flow of fluid, such as a flow of drilling fluid, along an exterior surface of tool assembly 22. The flow of fluid can be through annulus 48 that is defined between an outer diameter surface of tool assembly 22 and an inner diameter surface of outer tool tubular 24.

The non-electrically conductive fluid can contact central heat exchanger 39 and be cooled down by the coolant fluid. The cooled non-electrically conductive fluid will be directed towards fluid guides 50 with flow created by impeller 40. Fluid guides 50 extend generally axially from compressor 38 towards electronics compartment 30 creating a flow path allowing the non-electrically conductive fluid to circulate freely between central heat exchanger 39 and electronics compartment 30. The cooled non-electrically conductive fluid is directed towards impeller 40 by fluid guides 50. Impeller 40 will in turn direct the cooled non-electrically conductive fluid towards electronics compartment 30.

The non-electrically conductive fluid departs central heat exchanger 39 of compressor 38 as cooled non-electrically conductive fluid 100. Cooled non-electrically conductive fluid 100 then passes through electronics compartment 30. As cooled non-electrically conductive fluid 100 circulates through electronics compartment 30, an amount of heat will be transferred into cooled non-electrically conductive fluid 100 from electronics components 32 to form heated non-electrically conductive fluid 110. Heated non-electrically conductive fluid 110 circulates back to central heat exchanger 39 guided by fluid guides 50. As the heated non-electrically conductive fluid passes through central heat exchanger 39, an amount of heat will be removed from the heated non-electrically conductive fluid 110 to form cooled non-electrically conductive fluid 100.

In an example of operation, looking at FIG. 1, tubular string 14 can be a drill string used to drill subterranean well 10. Downhole tool 20 can be secured in-line as part of tubular string 14. Looking at FIG. 2, downhole tool 20 can include electronics components 32 that can become heated by the high temperature conditions of the wellbore downhole.

Looking at FIG. 2, cooling system 36 can be used to reduce the temperature of electronics components 32. Cooled non-electrically conductive fluid 100 can be directed into electronics compartment 30 and over and past electronics components 32. Electronics components 32 can be submerged in the non-electrically conductive fluid so that heat from electronics components 32 can be directly transferred to the non-electrically conductive fluid.

Embodiments described in this disclosure therefore provide systems and methods for cooling downhole electronics that will increase the downhole temperature range and depth where such electronics can be used. The cooling of the electronics component can reduce the failure rate, and can increase the quality and the longevity of downhole measurements by such electronics components.

Embodiments of this disclosure, therefore, are well adapted to carry out the objects and attain the ends and advantages mentioned, as well as others that are inherent. While embodiments of the disclosure has been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A system for cooling an electronics compartment of a downhole tool, the system including:

a tool assembly, the tool assembly being an elongated member formed of axially aligned tool units, the tool units including:

a turbine;

the electronics compartment having an interior cavity containing electronics components;

a compressor powered by the turbine, the compressor operable to compress a coolant fluid, the compressor having a central heat exchanger operable to cool a non-electrically conductive fluid with the coolant fluid;

and an impeller rotated by the turbine, the impeller operable to circulate the non-electrically conductive fluid past the electronics components.

2. The system of claim 1, further including a centralizer circumscribing the tool assembly and operable to centralize the tool assembly within an outer tool tubular.

3. The system of claim 2, where the outer tool tubular is secured in-line with a drilling string.

4. The system of claim 1, where the tool assembly defines a measurement while drilling downhole tool.

5. The system of claim 1, where the tool assembly has an axial length in a range of 5 meters to 10 meters.

6. The system of claim 1, where the electronics components are submerged within the non-electrically conductive fluid.

7. A system for cooling an electronics compartment of a downhole tool, the system including:

a tool assembly, the tool assembly being an elongated member formed of axially aligned tool units, the tool units including:

a turbine located at a downhole end of the tool assembly;

a rotary compressor located axially adjacent to the turbine and rotated by the turbine, the rotary compressor operable to compress a coolant fluid, the rotary compressor having a central heat exchanger operable to cool a non-electrically conductive fluid with the coolant fluid;

the electronics compartment located axially adjacent to the rotary compressor, the electronics compartment having an interior cavity containing electronics components; and an impeller rotated by the turbine, the impeller operable to direct the non-electrically conductive fluid from the rotary compressor to the electronics compartment.

8. The system of claim 7, further including a centralizer circumscribing the tool assembly and operable to centralize the tool assembly within an outer tool tubular.

9. The system of claim 8, where the outer tool tubular is secured in-line with a drilling string.

10. The system of claim 8, where an outer heat exchanger of the rotary compressor is in thermal communication with a flow of fluid external to the tool assembly that is within the outer tool tubular.

11. The system of claim 7, where the tool assembly has an axial length in a range of 5 meters to 10 meters.

12. The system of claim 7, where electronics components are submerged within the non-electrically conductive fluid.

13. A method for cooling an electronics compartment of a downhole tool, the method including:

forming a tool assembly, the tool assembly being an elongated member formed of axially aligned tool units, the tool units including:

a turbine;

the electronics compartment having an interior cavity containing electronics components;

a compressor with a central heat exchanger; and an impeller;

powering the compressor with the turbine to compress a coolant fluid;

cooling a non-electrically conductive fluid with the coolant fluid in the central heat exchanger; and rotating the impeller with the turbine to circulate the non-electrically conductive fluid past the electronics components.

14. The method of claim 13, further including centralizing the tool assembly within an outer tool tubular with a centralizer circumscribing the tool assembly.

15. The method of claim 14, further including securing the outer tool tubular in-line with a drilling string.

16. The method of claim 13, where forming the tool assembly includes forming the tool assembly that is a measurement while drilling downhole tool.

17. The method of claim 13, where forming the tool assembly includes forming the tool assembly with an axial length in a range of 5 meters to 10 meters.

18. The method of claim 13, further including submerging the electronics components within the non-electrically conductive fluid.

* * * * *